US006878039B2

(12) United States Patent
Yang et al.

(10) Patent No.: US 6,878,039 B2
(45) Date of Patent: Apr. 12, 2005

(54) POLISHING PAD WINDOW FOR A CHEMICAL-MECHANICAL POLISHING TOOL

(75) Inventors: Charles Chiun-Chieh Yang, Gilbert, AZ (US); John D. Herb, Phoenix, AZ (US); Stephen C. Schultz, Gilbert, AZ (US)

(73) Assignee: Speedfam-IPEC Corporation, Chandler, AZ (US)

( * ) Notice: Subject to any disclaimer, the term of this patent is extended or adjusted under 35 U.S.C. 154(b) by 81 days.

(21) Appl. No.: 10/058,743

(22) Filed: Jan. 28, 2002

(65) Prior Publication Data

US 2003/0143925 A1 Jul. 31, 2003

(51) Int. Cl.[7] ..... B24B 49/00
(52) U.S. Cl. ..... 451/6; 451/287; 451/288
(58) Field of Search ..... 451/6, 287, 288, 451/533, 41; 356/381

(56) References Cited

U.S. PATENT DOCUMENTS

| | | | | |
|---|---|---|---|---|
| 2,490,950 A | * | 12/1949 | Dryer | 337/243 |
| 5,433,651 A | | 7/1995 | Lustig et al. | 451/5 |
| 5,605,760 A | | 2/1997 | Roberts | 428/409 |
| 5,609,511 A | | 3/1997 | Moriyama et al. | 451/5 |
| 5,838,447 A | | 11/1998 | Hiyama et al. | 356/381 |
| 5,893,796 A | * | 4/1999 | Birang et al. | 451/526 |
| 5,943,302 A | * | 8/1999 | Fanshaw | 368/276 |
| 5,949,927 A | | 9/1999 | Tang | 385/12 |
| 6,045,439 A | | 4/2000 | Birang et al. | 451/526 |
| 6,068,539 A | | 5/2000 | Bajaj et al. | 451/6 |
| 6,106,662 A | | 8/2000 | Bibby, Jr. et al. | 156/345 |
| 6,146,242 A | * | 11/2000 | Treur et al. | 451/6 |
| 6,280,297 B1 | * | 8/2001 | Tolles et al. | 451/41 |
| 6,454,630 B1 | * | 9/2002 | Tolles | 451/6 |
| 6,485,354 B1 | * | 11/2002 | Wolf | 451/6 |
| 6,488,568 B1 | * | 12/2002 | Treur et al. | 451/6 |

FOREIGN PATENT DOCUMENTS

| | | |
|---|---|---|
| EP | 0 824 995 | 2/1998 |

* cited by examiner

*Primary Examiner*—Joseph J. Hail, III
*Assistant Examiner*—Alvin J Grant
(74) *Attorney, Agent, or Firm*—Ingrassia Fisher & Lorenz PC

(57) ABSTRACT

A polishing pad assembly for use in a chemical-mechanical polishing apparatus comprises a polishing pad having at least a first aperture therethrough and a platen for supporting the polishing pad having a second aperture therethrough at least a portion of which is larger than the first aperture. A substantially transparent plug includes at least a first section having a first dimension for positioning substantially within the first aperture and at least a second section having a second dimension larger than the first dimension for positioning substantially within the second aperture. The optical plug is made of a polymeric material which may be press-fit through the platen into polishing pad.

26 Claims, 5 Drawing Sheets

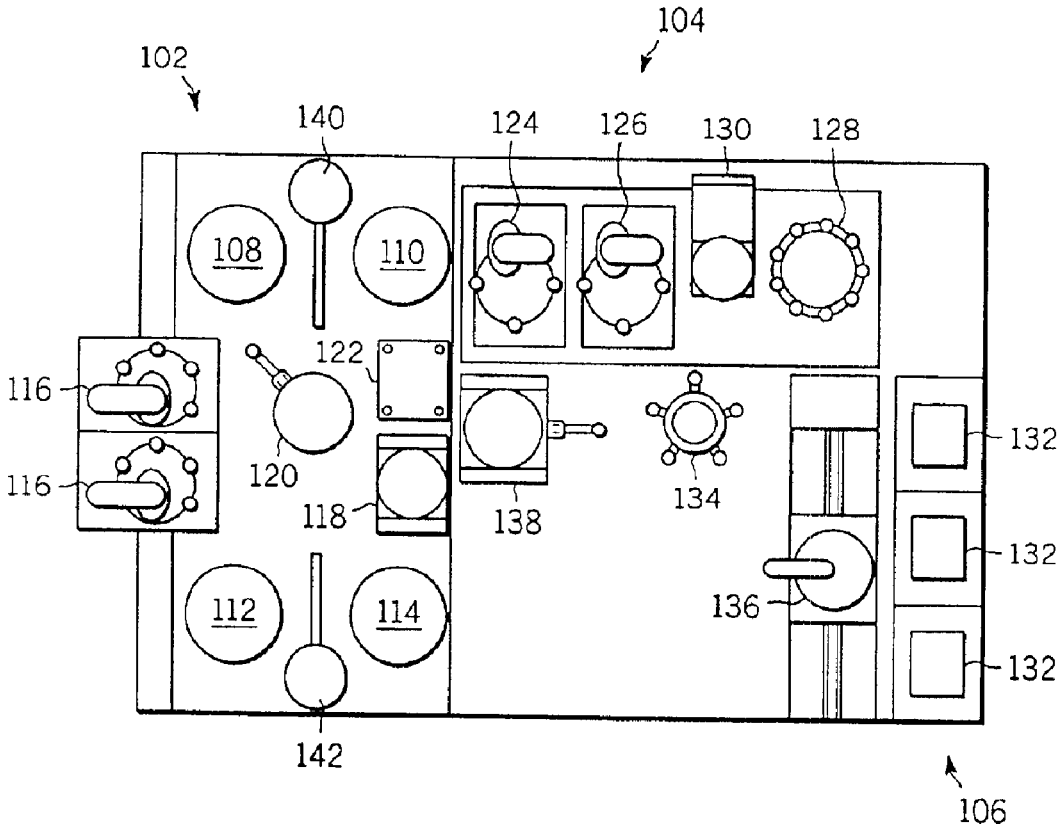
FIG. 1
FIG. 2
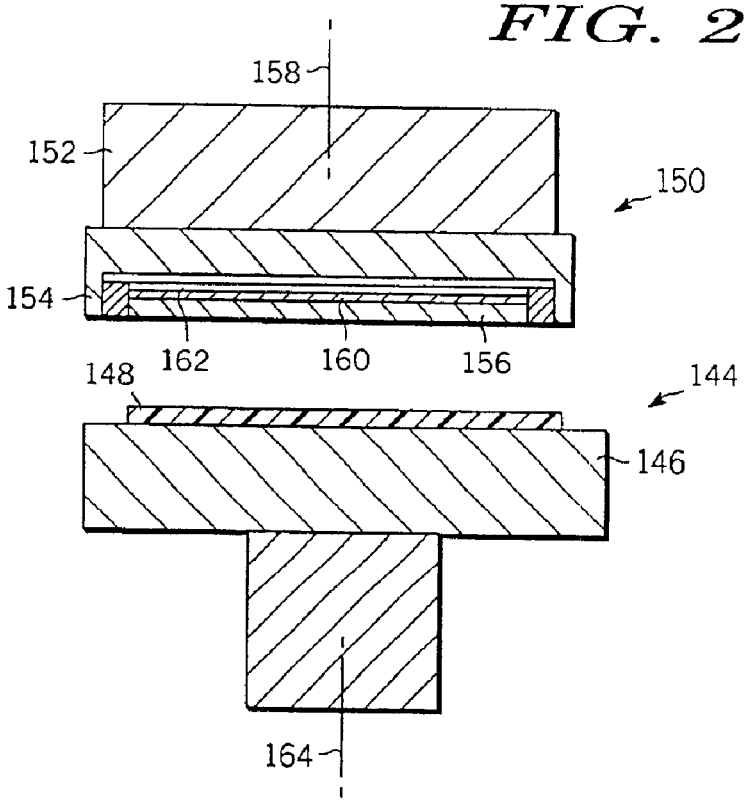

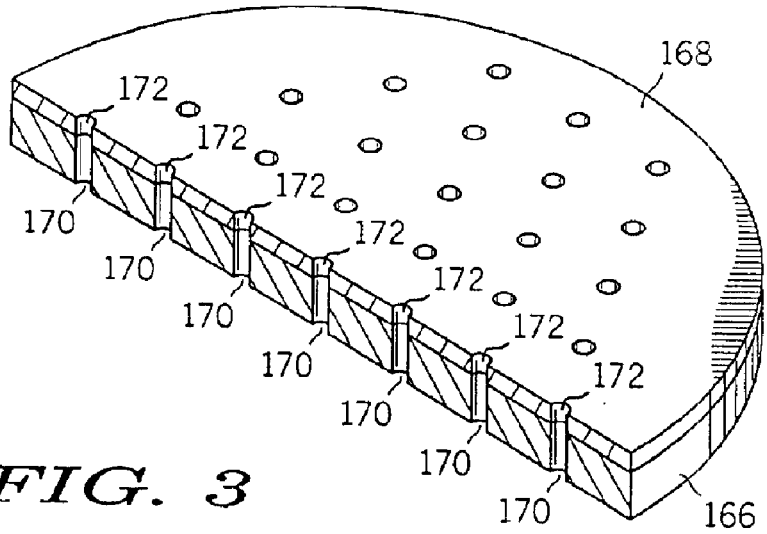
FIG. 3
FIG. 4
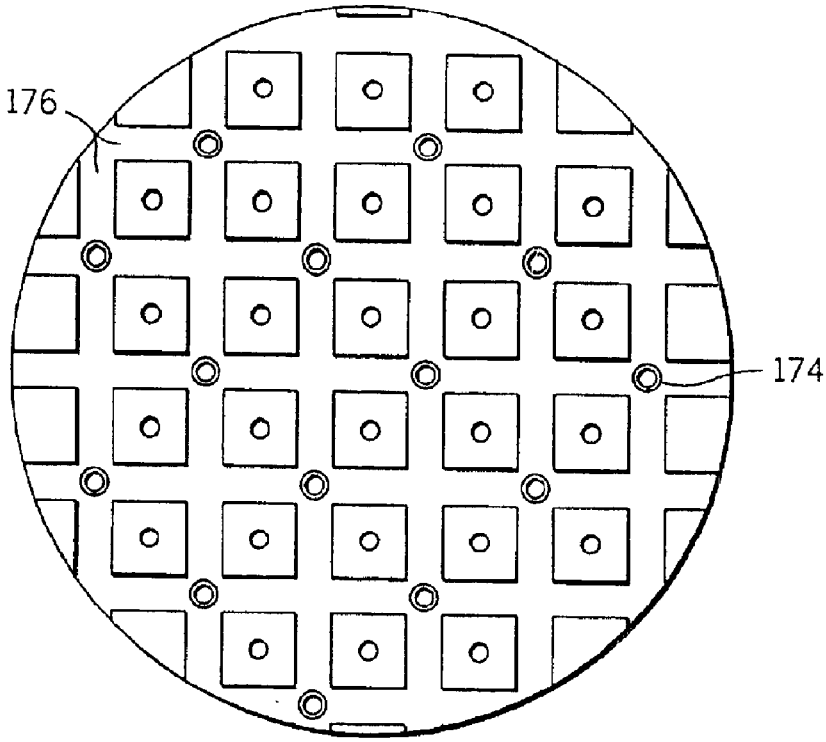

POLISHING PAD WINDOW FOR A CHEMICAL-MECHANICAL POLISHING TOOL

TECHNICAL FIELD

The present invention relates generally to an apparatus and method for polishing a surface of a workpiece. More particularly, the invention relates to improved methods and apparatus for utilizing chemical-mechanical planarization in the manufacture of semiconductors. Still more specifically, the present invention relates to improved methods and apparatus for monitoring a semiconductor wafer during a chemical-mechanical polishing process.

BACKGROUND OF THE INVENTION

Chemical-mechanical polishing or planarization of the surface of an object may be desirable for several reasons. For example, a flat disk or wafer of single crystal silicon is the basic substrate material in the semiconductor industry for the manufacture of integrated circuits. Semiconductor wafers are typically created by growing an elongated cylinder or boule of single crystal silicon and then slicing individual wafers from the cylinder. The slicing causes both faces of the wafer to be extremely rough. The front face of the wafer on which integrated circuitry is to be constructed must be extremely flat in order to facilitate reliable semiconductor junctions with subsequent layers of material applied to the wafer. Also, the material layers (composite thin film layers usually made of metals for conductors or oxides for insulators) applied to the wafer must also be made of a uniform thickness.

Planarization is the process of removing projections and other imperfections to create a flat planar surface and/or a uniform thickness for a deposited thin film layer on a wafer. Semiconductor wafers are planarized or polished to achieve a smooth, flat finish before performing lithographic processing steps that create integrated circuitry or interconnects on the wafer. A considerable amount of effort in the manufacturing of modem complex, high-density multilevel interconnects is devoted to the planarization of the individual layers of the interconnect structure. Non-planar surfaces result in poor optical resolution of subsequent photolithographic processing steps which in turn prohibits the printing of high-density features. If a metallization step height is too large, there is a serious danger that open circuits will be created. Since planar interconnect surface layers are required for the fabrication of modem high density integrated circuits, chemical-mechanical polishing (CMP) tools have been developed to provide controlled planarization of both structured and unstructured wafers.

In a conventional CMP tool for planarizing a wafer, the wafer is secured in a carrier connected to a shaft. The shaft is typically connected to mechanical means for transporting the wafer between a load or unload station and a position adjacent to a polishing pad mounted to a rigid or a flexible platen. Pressure is exerted on the back surface of the wafer by the carrier in order to press the wafer against the polishing pad usually in the presence of a slurry. The wafer and/or polishing pad are then moved in relation to each other by means of, for example, motors connected to the shaft and/or platen, in order to remove material in a planar manner from the front surface of the wafer.

It is often desirable to monitor the front surface of a wafer during the planarization process. One known method involves the use of an optical system that interrogates the front surface of the wafer in situ by positioning an optical probe under the polishing surface and transmitting and receiving an optical signal through an opening in the polishing pad. In some systems, the opening in the polishing pad is filled with an optically transparent material, or "window", in order to prevent polishing slurry or other contaminants from being deposited into the probe and obscuring the optical path to the wafer. It is possible to adjust the planarization process based upon these real-time measurements or to terminate the process when the front surface of the wafer has reached the desired condition. However, current window technology presents certain problems. One such problem is that separation starts to form at the surfaces between the window and the polishing pad when the polishing pad is stressed during the planarization process of the wafer. Even extremely small separations are undesirable because contamination can accumulate within the separations and scratch the front surface of the wafer or cause optical interference. Scratching and optical interference can also result from abrasive particles becoming trapped in the window material itself or from the surface of the window projecting above the surrounding pad material. In addition, the optical clarity of the pad window can be degraded due to the presence of trapped gas bubbles within the window material. Still other problems include chemical degradation, staining, and poor optical clarity of the window.

There are two generally known methods of manufacturing optical windows of the type described above. The first involves providing a hole in the polishing pad and filling that hole with epoxy. It is then necessary to cure or solidify the optical material placed in the hole. A second approach involves the placing of a solid optically transparent plug into the hole and then bonding the plug to the surfaces of the hole through the use of adhesives. Unfortunately, neither of these methods provides reliable manufacturing consistency, both are costly and complex, and optical windows manufactured using the known techniques are difficult to remove and/or replace.

In view of the foregoing, it should be appreciated that it would be desirable to provide an improved polishing pad/platen window or lens for use in a chemical-mechanical polishing apparatus that exhibits good optical properties through which in situ monitoring of the wafer may be accomplished during the chemical-mechanical polishing process. It would further be desirable that the polishing pad/platen window or lens be easy to manufacture, easy to deploy in the polishing pad/platen, and easy to remove and replace.

Additional desirable features will become apparent to one skilled in the art from the foregoing background of the invention and following detailed description of a preferred exemplary embodiment and appended claims.

SUMMARY OF THE INVENTION

The present invention provides improved methods and apparatus for chemical-mechanical polishing of a surface of a workpiece that overcome many of the shortcomings of the prior art.

In accordance with the first aspect of the invention, there is provided a polishing assembly for use in a chemical-mechanical polishing apparatus which comprises a polishing pad having at least a first aperture therethrough and a platen for supporting the polishing pad having at least a second aperture therethrough which is larger than the first aperture. A substantially transparent plug including at least a first section having a first dimension and a second section having a second dimension larger than the first dimension is inserted through the platen into the polishing pad such that the first section is positioned substantially within the first aperture and the second section is positioned substantially within the second aperture. The transparent plug is made of a polymeric material and is capable of being press-fit through the platen into the polishing pad.

According to another aspect of the invention, there is provided an improved optical plug for providing an optical path through a platen and a polishing pad of a chemical-mechanical polishing apparatus, the plug comprising a first section having a first dimension for positioning within the polishing pad and a second section having a second larger dimension for positioning in the platen.

BRIEF DESCRIPTION OF THE DRAWINGS

The following drawings are illustrative of particular embodiments of the invention and therefore do not limit the scope of the invention but are presented to assist in providing a proper understanding of the invention. The drawings are not to scale (unless so stated) and are intended for use in conjunction with the explanations in the following detailed description. The present invention will hereinafter be described in conjunction with the drawings, wherein like referenced numerals denote like elements, and;

FIG. 1 is a top cutaway view of a polishing apparatus suitable for removing material from the surface of a workpiece in accordance with the present invention;

FIG. 2 is a cross-sectional view of a polishing apparatus suitable for use in the apparatus shown in FIG. 1;

FIG. 3 is a cross-sectional view of a lower portion of the lower polishing module shown in FIG. 2;

FIG. 4 is a top view of a polishing pad surface illustrating apertures extending therethrough;

DETAILED DESCRIPTION OF EXEMPLARY EMBODIMENTS

Figure 5:
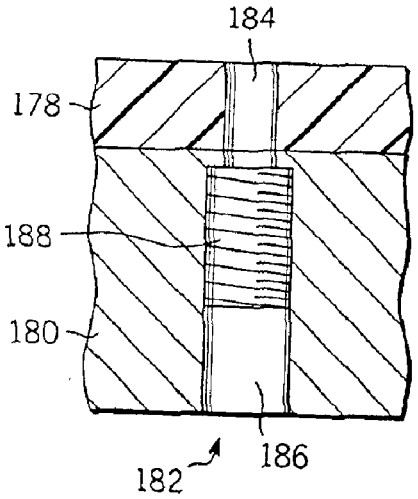
FIG. 5 is a cross-sectional view of a platen/polishing pad assembly having an aperture therethrough in accordance with the first embodiment of the present invention.

This description is exemplary in nature and is not intended to limit the scope, applicability, or the configuration of the invention in any way. Rather, the following description provides a convenient illustration for implementing exemplary embodiments of the invention. Changes to the described embodiments may be made in the function and arrangement of the elements described without departing from the scope of the invention.

FIG. 1 illustrates a top cutaway view of a polishing apparatus suitable for removing material from a surface of a workpiece in accordance with the present invention. The apparatus includes a multi-platen polishing system 102, a cleaning system 104, and a wafer load and unload station 106. In addition, the apparatus includes a cover (not illustrated) that surrounds the apparatus to isolate it from the surrounding environment. An example of such an apparatus is a Momentum machine available from SpeedFan-IPEC Corporation of Chandler, Ariz.; however, it may be any machine capable of removing material from a workpiece surface.

Although the present invention may be used to remove material from a surface of a variety of workpieces such as magnetic disks, optical disks, and the like, the invention is conveniently described below in connection with removing material from a surface of a semiconductor wafer. In the context of the present invention, the term "wafer" shall mean semiconductor substrates, that may or may not include layers of insulating, semiconducting, and conducting layers or features formed thereon and used in the manufacture of microelectronic devices.

Exemplary polishing system 102 includes four polishing stations 108, 110, 112, and 114, each of which operate independently; a buff station 116; a transition stage 118; a robot 120; and optionally, a metrology station 122. Polishing stations 108–114 may be configured as desired to perform specific functions; however, in accordance with the present invention, at least one of the stations 108–114 includes a polishing pad/platen assembly having a window or lens therein which provides for the in situ monitoring of a wafer during chemical-mechanical polishing as will be described hereinbelow. The remaining polishing station may be configured for chemical-mechanical polishing, electrochemical polishing, electrochemical deposition, or the like.

Polishing system 102 also includes polishing surface conditioners 140 and 142. The configuration of conditioners 140 and 142 generally depend on the type of polishing surface to be conditioned. For example, when the polishing surface comprises a polyurethane polishing pad, conditioners 140 and 142 suitably include a rigid substrate coated with a diamond material. Various other surface conditioners may also be used.

Clean system 104 is generally configured to remove debris such as slurry residue and material detached from the wafer surface during polishing. System 104 includes clean stations 124 and 126, a spin rinse dryer 128, and a robot 130 configured to transport the wafer between clean stations 124 and 126 and spin rinse dryer 128. Each clean station 124 and 126 includes two concentric circular brushes which contact the top and bottom surfaces of a wafer during a cleaning process. Alternatively, clean station 104 may be separate from the remainder of the electrochemical planarization apparatus. In this case, load station 106 is configured to receive dry wafers for processing, but the wafers may remain in a wet (e.g., deionized water) environment until the wafers are transferred to the clean station.

In operation, cassettes 132 including one or more wafers, are loaded at station 106. The wafers are then individually transferred to a stage 134 using a dry robot 136. A wet robot 138 retrieves a wafer at stage 132 and transfers the wafer to metrology 122 or to stage 118 within polishing system 102. Robot 120 picks up the wafer from metrology station 122 or stage 118 and transfers the wafer to one of polishing stations 108–114 for electrochemical planarization. After a desired amount of material has been removed, the wafer may be transferred to another polishing station. Alternatively, the polishing environment within one of the stations may be changed from an environment suitable for electrochemical planarization to electrochemical deposition; e.g., by changing the solution and the bias applied to the wafer. In this case, a single polishing station may be used to both deposit material and remove material from the wafer. After conducting material has been removed from the wafer surface, the wafer is transferred to buff station 116 to further polish the surface of the wafer. After the polishing and/or buff process, the wafer is transferred to stage 118 which is configured to maintain one or more wafers in a wet environment.

After the wafer is placed in stage 118, robot 138 picks up the wafer and transfers it to clean system 104. In particular, robot 138 transfers the wafer to robot 130, which in turn places the wafer in one of clean stations 124 or 126. The wafer is cleaned using one or more stations 124 and 126 and then is transported to spin rinse dryer 128 to rinse and dry the wafer prior to transporting it to load/unload station 106 using robot 136.

FIG. 2 is a cross-sectional view of a polishing apparatus suitable for use in the apparatus shown in FIG. 1 for polishing a surface of a wafer in accordance with the present invention. The apparatus includes a lower polishing module 144 that in turn includes a platen 146 and a polishing surface or pad 148. An upper polishing module 150 includes a body 152 and a retaining ring 154 which retains wafer 156 during polishing.

Upper polishing module or carrier 150 is generally configured to receive a wafer for polishing and urge the wafer against the polishing surface during the polishing process. Carrier 150 applies a vacuum force to the back side of wafer 156, retains the wafer, moves in the direction of the polishing surface to place the wafer in contact with polishing surface 148, releases the vacuum, and applies a force (e.g., about 3 PSI) in the direction of the polishing surface. In addition, carrier 150 is configured to cause the wafer to move. For example, carrier 150 may be configured to cause the wafer to move in a rotational, orbital, or translational direction. Carrier 150 may be configured to rotate at a rate between two RPM and twenty RPM about an axis 158.

Carrier 150 also includes a resilient film 160 interposed between wafer 156 and body 152 to provide a cushion during the polishing process and may also include an air bladder 162 configured to provide a desired, controllable pressure to a backside of the wafer during the polishing process. In this case, the bladder may be divided into zones such that various amounts of pressure may be independently applied to each zone.

Lower polishing module 144 is generally configured to cause the polishing surface to move. By way of example, lower module 144 may cause the polishing surface to rotate, translate, orbit, or any combination thereof. For example, lower module 144 may be configured such that platen 146 orbits at a radius of approximately one-quarter inch to one inch about an axis 164 at, for example, 30 to 340 orbits per minute while simultaneously causing platen 146 to dither or partially rotate. In this case, material is removed primarily from the orbital motion of module 146. This allows a relatively constant speed between the wafer surface and the polishing surface to be maintained during a polishing process, and thus material removal rates are maintained relatively constant across the wafer surface.

Polishing machines including orbiting lower modules 144 are additionally advantageous because they require relatively little space when compared to rotational polishing modules. In particular, because a relatively constant velocity between the wafer surface and the polishing surface can be maintained across the wafer surface by moving the polishing surface in an orbital motion, the polishing surface can be about the same size as the surface to be polished. For example, a diameter of a polishing surface may be only 0.5 inches greater than the diameter of the wafer.

FIG. 3 is a cross-sectional view of a lower portion of the lower polishing module shown in FIG. 2. It includes the platen 166 and a polishing surface 168 suitable for use in conjunction with the polishing apparatus shown in FIG. 2. Platen 166 and polishing surface or pad 168 include channels 170 and 172 formed therein to allow polishing fluid such as a slurry to flow through platen 166 and surface 168 towards a surface of the wafer during the polishing process. Flowing slurry toward the surface of the wafer during the polishing process is advantageous because the slurry acts as a lubricant and thus reduces friction between the wafer surface and the polishing surface 168. In addition, providing slurry through the platen and toward the wafer facilitates uniform distribution of the slurry across the surface of the wafer which in turn facilitates uniform material removal from the wafer surface. Slurry flow rates may be selected for a particular application; however, the slurry flow rates are generally less than 200 ml/minute and preferably about 120 ml/minute.

FIG. 4 is a top view of a polishing pad surface and illustrates apertures 174 extending through the polishing pad to permit the polishing solution or slurry to circulate through the platen and polishing pad as described above in connection with FIG. 3. The surface of the polishing pad also includes grooves 176 configured to effect transportation of the polishing solution on the polishing surface. The polishing surface may be porous thus further facilitating transportation of the polishing solution. As an example, the polishing pad may be formed from polyurethane and have thickness of approximately 0.050 to 0.080 inches. Grooves 106 may be formed, for example using a gang saw, such that the grooves are from 0.015 to 0.045 inches deep with a pitch of approximately 0.2 inches and a width of approximately 0.15 to 0.30 inches.

As stated previously, it is often desirable to monitor the front surface of the wafer in situ during the planarization process. This can be accomplished by positioning an optical probe under the polishing pad and/or platen so as to transmit and receive an optical signal through an opening in the polishing pad and/or platen.

FIG. 5 is a cross-sectional view of a polishing pad/platen assembly comprised of polishing pad 178 disposed on and proximate to platen 180. Polishing pad 178 and platen 180 may be of the type shown and described above in connection with FIG. 3. Polishing pad 178, typically made of a urethane material, may have one or more layers depending on the characteristics of the particular semiconductor wafer being planarized and the desired results. For example, an IC 1000 polishing pad may be used alone or may be laid over a Suba IV backing pad to create a single polishing pad 178. The IC 1000 polishing pad and Suba IV backing pad are commercially available from Rodel Corporation having offices in Phoenix, Ariz. However, it should be clear to one skilled in the art that other types of polishing pads may be employed.

In order to create the optical window necessary to perform the desired in situ planarization monitoring, it is first necessary to create an aperture or opening 182 through both pad 178 and 180. This opening may be created using a number of well-known techniques such as punching, drilling, tapping, etc. While only one opening 182 is shown in FIG. 5, it should be clear that any number of holes may be created in the pads/platen assembly in order to accommodate the needs of the particular metrology system being employed. Furthermore, hole or opening 182 may be created at any desired location. For example, it may be desirable to position the opening across a slurry groove (176 in FIG. 4), at the intersection of two or more grooves, or in an area not occupied by grooves. The size of the openings 182 may vary depending on the particular requirements of the metrology instrument, and while the invention is in no way limited to any particular hole size, a hole of approximately 3 millimeters in diameter has been found to be sufficient for taking optical measurements without noticeably interfering with the planarization process.

Referring again to FIG. 5, it can be seen that opening 182 has a first portion 184 (e.g. generally cylindrical and having a first diameter) extending through polishing pad 178 and a second larger portion 186 (e.g. generally cylindrical with a large diameter) having an internally threaded section 188 extending through platen 180.

Figure 6:
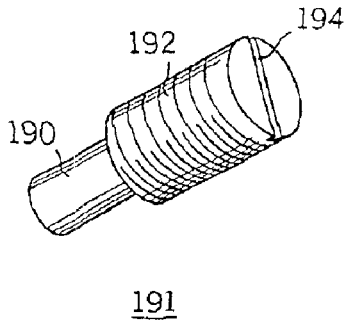
FIG. 6 is an isometric view of an optical plug for insertion into the aperture shown in FIG. 5.
Figure 7:
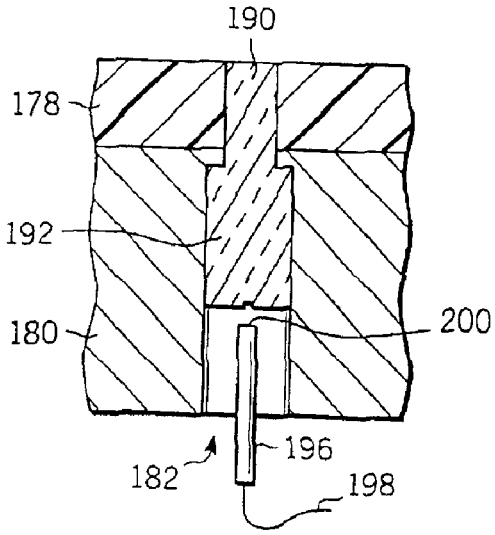
FIG. 7 is cross-sectional view of a platen/polishing pad assembly illustrating the optical plug shown in FIG. 6 inserted within the aperture shown in FIG. 5.

An optical plug 191 which is configured to fit into opening 182 is shown in FIG. 6. As can be seen, it contains a generally cylindrical stem portion 190 and a larger externally threaded head portion 192 having a slot 194 formed in an upper surface thereof for receiving the head of a standard screwdriver or similar tool. The optical plug is capable of being screwed into opening 182 until stem portion 190 extends through polishing pad 178 as is shown in FIG. 7. An optical probe 196 may then be positioned to transmit light through optical plug 191 which then impinges upon the surface of a wafer being planarized. Light reflected from the wafer propagates back through optical plug 191 and is received at probe 196. It should be clear that while opening 182 and plug 191 have been described as having a generally cylindrical cross-section, other shapes and configurations may be employed.

The material from which optical plug 191 is made should have a hardness which is substantially the same as that of polishing pad 178; e.g., a hardness of approximately 35 to 55 on the shore "D" gauge for conventional polishing pads. If the polishing pad 178 is softer than the optical plug, the polishing pad will compress to a greater extent during the planarization process thereby causing the optical plug to protrude above the surface of the polishing pad possibly scratching or damaging the wafer being polished. Preferably, the hardness of the optical plug and polishing pad 178 are preferably within approximately plus or minus 10 on the shore "D" gage of each other.

Material from which optical plug 191 is manufactured (e.g., by injection molding or the like) should have approximately the same wear resistance as the polishing pad. If polishing pad 178 wears faster than optical plug 191, the plug will eventually protrude and may scratch the front face of the wafer. If polishing pad 178 wears more slowly than optical plug 191, the optical plug will eventually become recessed thus trapping debris and thereby attenuating transmitted or reflected light. Optical plug 191 should be made of a material which does not stain when exposed to the slurry or material removed from the surface of the wafer since staining will greatly limit the light transmission characteristics of the optical window. Furthermore, the optical plug should not react with the slurry being utilized.

It should be clear that the optical plug should accommodate the range of frequencies needed by the metrology instruments with minimal attenuation and distortion. However, an optical plug that passes a broad spectrum of light will be the most versatile and capable of functioning with metrology instruments which require a wider spectrum to operate.

Based on the above factors, a material which is preferably utilized to form optical plugs comprise an optical grade acrylic-urethane aligomer. Such materials are sold under the trade name OP29 and OP29V and are commercially available from Dymax Corporation which is located in Torrington, Conn.

Referring again to FIG. 7, optical probe 196 houses optical fiber 198 that has a transmitting and receiving end 200 placed proximate, or in contact with optical plug 191. A small amount of optical coupling gel may be used between optical plug 191 and probe 196. A suitable gel for this purpose is manufactured by Nye Lubricants, Inc. located in New Bedford, Mass. and is sold under the trade name Optical Gel—OCK-451. It should be recognized, however, that other suitable gels or coupling arrangements may be utilized.

Figure 8:
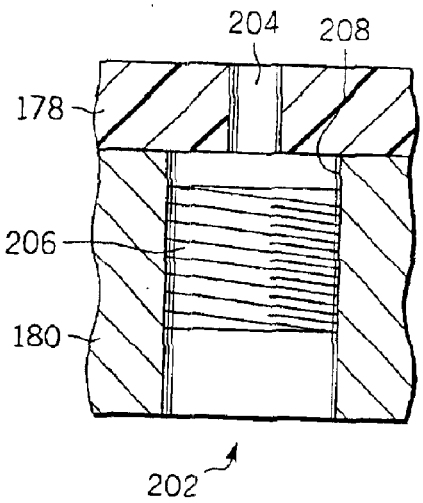
FIG. 8 is cross-sectional view of a platen/polishing pad assembly having apertures therethrough in accordance with the further embodiment of the present invention.

FIG. 8 is a cross-sectional view of the polishing pad/platen assembly which is configured to retain an optical plug in accordance with a second exemplary embodiment. As can be seen, aperture or opening 202 comprises a cylindrical opening 204 which extends through polishing pad 178 and a larger cylindrical opening (i.e., one having a larger diameter) having an internally threaded portion 206 and a flat walled portion 208. Again, this opening may be manufactured by any suitable technique such as drilling, tapping, punching, etc.

Figure 9:
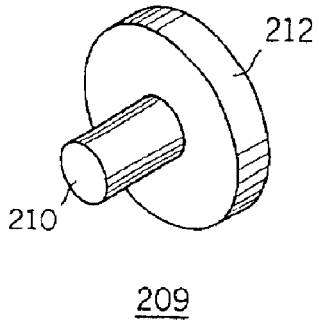
FIG. 9 is an isometric view of an optical plug for insertion into the aperture shown in FIG. 8.
Figure 10:
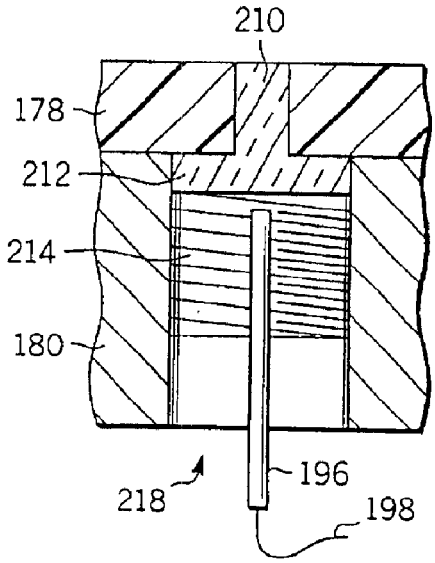
FIG. 10 is cross-sectional view of a platen/polishing pad assembly wherein the optical plug shown in FIG. 9 is inserted into the aperture shown in FIG. 8.
Figure 11:
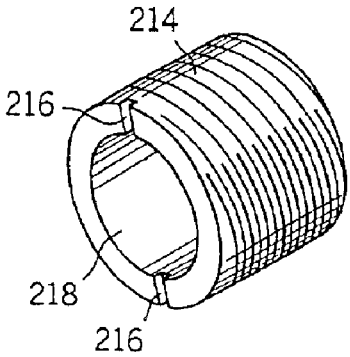
FIG. 11 is an isometric view of a externally threaded retainer for use in conjunction with the platen/polishing pad assembly shown in FIG. 10.

FIG. 9 illustrates an optical plug 209 suitable for reception within opening 202 in FIG. 8. Optical plug 209 includes a stem portion 210 and a head portion 212. This optical plug is then inserted or press-fit into opening 202 as is shown in FIG. 10. If necessary, the plug may be secured into position by means of a hollow externally threaded backing or retaining screw 214 shown in more detail in FIG. 11. As can be seen, backing screw 214 contains slots 216 in a face thereof to permit it to be screwed into position by a standard screwdriver or similar tool. Backing screw 214 has an opening 218 therethrough so as to allow optical probe 196 to be positioned proximate optical plug 209 as is shown in FIG. 10.

Figure 12:
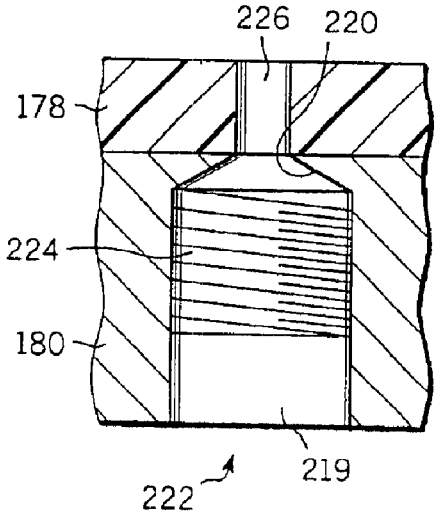
FIG. 12 is a cross-sectional view of platen/polishing pad assembly in accordance with a still further embodiment of present invention.
Figure 13:
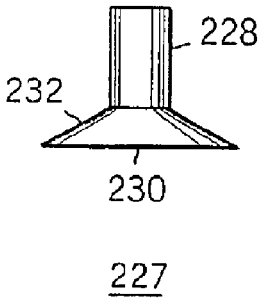
FIG. 13 is isometric view of an optical plug produced in conjunction with platen/polishing pad assembly shown in FIG. 12.
Figure 14:
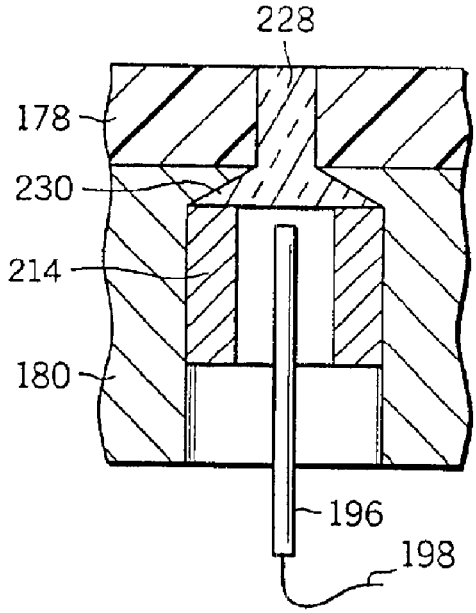
FIG. 14 is a cross-sectional view of a platen/polishing pad assembly incorporating the optical plug shown in FIG. 13 into the aperture shown FIG. 12.

FIGS. 12, 13, and 14 illustrate another embodiment of a light plug assembly for use in conjunction with a polishing pad/platen. Referring to FIG. 12, it can be seen that an opening 222 is formed through polishing pad 178 and platen 180 which is similar to opening 202 in FIG. 8 except for inclined conical surface 220. Opening 222 also includes an internally threaded portion 224 and an opening of smaller diameter 226 extending through polishing pad 178. A light plug 227 configured to be used in connection with the polishing pad/platen assembly shown in FIG. 12 is shown in FIG. 13 and comprises a stem portion 228 and conical portion 230 having an inclined surface 232 which mates against surface 220 as is shown in FIG. 14. As was the case previously, a backing screw 214 may be employed to secure optical plug 227 into position while still permitting optical probe 196 to be properly positioned.

Figure 15:
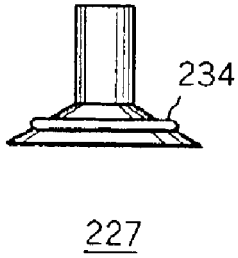
FIG. 15 is an isometric view of the optical plug shown in FIG. 13 having a sealing ring disposed thereround.

The optical plug configurations shown in connection with FIGS. 6, 9, and 13 have been found to provide adequate sealing with their respective mating surfaces in the polishing pad/platen assemblies so as to prevent slurry and other impurities from migrating through to the area occupied by optical probe 196. However, if enhanced sealing is desired, a sealing ring 234 (e.g. integrally formed) may be provided as is shown in FIG. 15.

Thus, there has been provided an improved polishing pad/platen window or lens for use in a chemical-mechanical polishing apparatus that exhibits good optical properties through which in situ monitoring of the wafer may be accomplished during the polishing process. An optical plug has been provided which is easy to manufacture, easy to deploy in the platen/polishing assembly, and easy to remove and replace.

In the foregoing specification, the invention has been described with reference to specific embodiments. However, it will be appreciated that various modifications and changes can be made without departing from the scope of the invention as set forth in the appended claims. Accordingly, the specification and drawings are to be regarded as illustrative rather than as restrictive, and all such modifications are intended to be included within the scope of the present invention.

What is claimed is:

1. A polishing assembly for use in a chemical mechanical polishing apparatus, comprising:

a polishing pad having at least a first aperture therethrough;

a platen for supporting said polishing pad, said platen having at least a second aperture therethrough having an internally threaded portion at least a portion of which is larger than the aperture of the polishing pad; and a substantially transparent plug including at least a first section having a first dimension and at least a second section having a second dimension larger than said first dimension, said first section for positioning substantially within said first aperture and said second section for positioning substantially within said second aperture.

2. A polishing assembly according to claim 1 wherein said second section has an externally threaded portion that is received by said internally threaded portion.

3. A polishing assembly according to claim 1 further comprising a retaining member for securing said plug is said first and second apertures.

4. A polishing assembly according to claim 3 wherein said retaining member is externally threaded and received by said internally threaded portion.

5. A polishing assembly according to claim 4 wherein said retaining member is hollow to provide an optical path to said optical plug.

6. A polishing assembly according to claim 1 wherein said second aperture includes a first surface which is substantially smooth.

7. A polishing assembly according to claim 6 wherein said second aperture includes a second internally threaded surface.

8. A polishing assembly according to claim 6 wherein said first aperture is substantially cylindrical.

9. A polishing assembly according to claim 8 wherein said second aperture is substantially cylindrical.

10. A polishing assembly according to claim 6 wherein said second aperture includes a substantially conical section.

11. A polishing assembly according to claim 1 wherein said plug is made of a polymeric material.

12. A polishing assembly according to claim 11 wherein said plug is insertable through said platen into said polishing pad.

13. A polishing assembly according to claim 12 wherein said plug is press-fit through said platen into said polishing pad.

14. A polishing assembly for use in a chemical-mechanical polishing apparatus, comprising:

a polishing pad having at least a first aperture therethrough;

a platen for supporting said polishing pad, said platen having at least a second aperture therethrough having an internally threaded section at least a portion of which is larger than said first aperture; and a removable, substantially transparent polymeric plug including at least a first section having a first dimension and at least a second section having a second dimension larger than said first dimension, said first section for positioning substantially within said first aperture and said second section for positioning substantially within said second aperture.

15. A polishing assembly according to claim 14 wherein said second section has an externally threaded portion that is received by said internally thread portion.

16. A polishing assembly according to claim 14 further comprising a retaining member for securing said plug in said first and second apertures.

17. A polishing assembly according to claim 16 wherein said retaining member is externally threaded and received by said internally threaded portion.

18. A polishing assembly according to claim 17 wherein said retaining member is hollow to provide an optical path to said optical plug.

19. A polishing assembly according to claim 14 wherein said second aperture includes a first surface which is substantially smooth.

20. A polishing assembly according to claim 19 wherein said second aperture includes a second internally threaded surface.

21. A polishing assembly according to claim 19 wherein said first aperture is substantially cylindrical.

22. A polishing assembly according to claim 21 wherein said second aperture is substantially cylindrical.

23. A polishing assembly according to claim 19 wherein said second aperture includes a substantially conical section.

24. An optical plug for providing an optical path through a platen/polishing pad of a chemical-mechanical polishing apparatus, said optical plug comprising:

a first section having a first dimension for positioning in said polishing pad; and a substantially conical second section coupled to the first section, the second section having a second larger dimension for positioning in said platen and having a threaded portion.

25. An optical plug according to claim 24 wherein said optical plug is made of a polymeric material.

26. An optical plug according to claim 25 wherein said second section includes an externally threaded portion.

* * * * *